US005434376A

United States Patent [19]

Hyatt et al.

[11] Patent Number: 5,434,376

[45] Date of Patent: Jul. 18, 1995

[54] SNAP-FIT TERMINAL ASSEMBLY

[75] Inventors: Edward A. Hyatt, Lawrenceburg; David E. Greer, Lexington; Terry A. Cassity, Paris; Kim D. Wheeler, Lexington, all of Ky.

[73] Assignee: Square D Company, Palatine, Ill.

[21] Appl. No.: 109,419

[22] Filed: Aug. 19, 1993

[51] Int. Cl.[6] ..... H01H 1/64

[52] U.S. Cl. ..... 200/293; 200/295; 200/296

[58] Field of Search ..... 200/293, 295, 294, 296, 200/297, 284

[56] References Cited

U.S. PATENT DOCUMENTS 3,398,249 8/1968 Dessert ..... 200/294
3,621,173 11/1971 O'Cheskey ..... 200/295
4,705,241 11/1987 Sadao et al. ..... 200/295

*Primary Examiner*—Henry J. Recla
*Assistant Examiner*—David J. Walczak
*Attorney, Agent, or Firm*—Larry I. Golden; Kareem M. Irfan; Wayne H. Stoppelmoor, Jr.

[57] ABSTRACT

The present invention provides a terminal and base for connecting a circuit through a fusible switch. The base has a plurality of undercut prongs upstanding therefrom and an interlock snap resiliently attached thereto. The prongs are positioned on the base to prevent movement vertically and in at least one direction horizontally. The snap is positioned on the base to prevent movement in the remaining horizontal directions. The terminal includes a generally planar body made of conductive material. The body has a plurality of edges adapted to insert into the undercut prongs. The terminal positions an opposing edge on the body opposite the plurality of edges. The opposing edge is adapted to abut one end of the interlock snap. The terminal includes a first and second means for electrically and mechanically connecting the terminal to the circuit.

27 Claims, 3 Drawing Sheets

Fig. 2
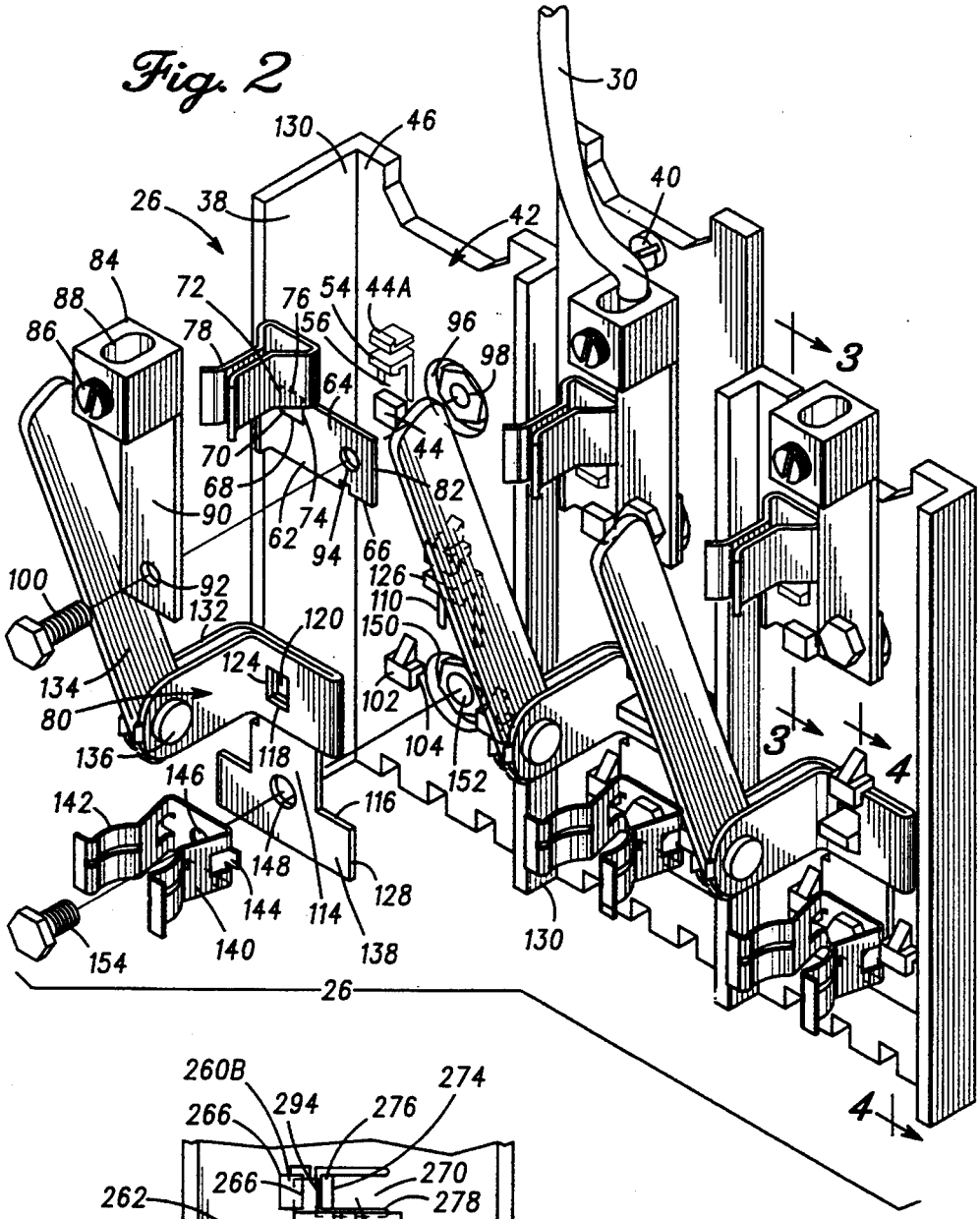
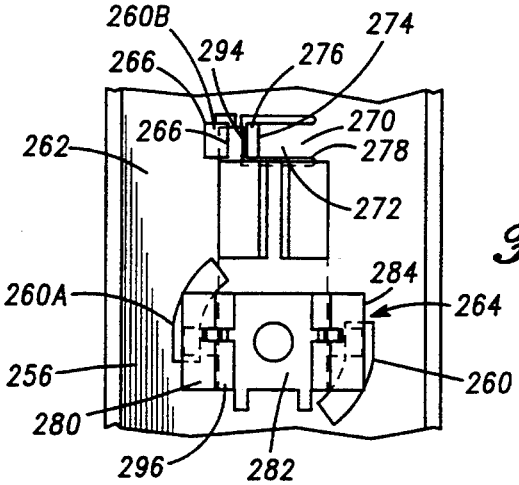
Fig. 7

SNAP-FIT TERMINAL ASSEMBLY

FIELD OF THE INVENTION

The present invention relates to fusible switches, circuit breakers, and the like, which have electrical terminals and, mope particularly, to a terminal assembly which provides a manual and demountable snap-fit connection to a load or line base.

BACKGROUND OF THE INVENTION

A fusible switch is usually mounted in an enclosure and incorporates an insulating base to carry an incoming line terminal for each phase. The circuit for each phase is completed through a pivotal knife blade which engages a corresponding contact stab and is electrically connected with a fuse clip having a fuse seated therein. In U.S. Pat. No. 4,302,643, commonly assigned to the Square D Company, a fusible switch is shown utilizing the above mentioned construction and which is hereby incorporated by reference.

Fusible switches are used in switchboards to distribute power for commercial and industrial applications. Typically, mounting screws are used to attach and retain fuse clips and other terminals to switch base interiors. The need arises to assemble the fusible switches in increasingly smaller enclosures providing little room for maneuvering. This requires electrical parts which can be assembled without complicated tools, or preferably, without any tools.

Other problems caused by assembling the fusible switch interiors is the quantity of parts that must be tracked, inventoried, and supplied in the field to properly complete the assembly. Another problem is the physical strain placed on the installer driving the mounting screws at various angles and locations. A reduced part count and less manual labor during assembly would decrease the installation time and cost.

Furthermore, the parts for the switch interior must be economical to manufacture. A switch which assembles easier and faster at a comparable cost allows more widespread application.

SUMMARY OF THE INVENTION

The present invention provides a terminal for connecting a fusible switch base to a circuit. The base has a plurality of undercut prongs upstanding therefrom and an interlock snap resiliently attached thereto. The prongs are positioned on the base to prevent movement vertically and in at least one direction horizontally. The snap is positioned on the base to prevent movement in the remaining horizontal directions.

The terminal includes a generally planar body made of conductive material. The body has a plurality of edges adapted to insert into the undercut prongs. The terminal positions an opposing edge on the body opposite the plurality of edges. The opposing edge is adapted to abut one end of the interlock snap. The terminal includes an upstanding leg connected to the body. The leg is formed with first means for electrically and mechanically connecting the leg to the circuit. The body is formed with second means for electrically and mechanically connecting the end of the body opposite the leg to the other end of the circuit.

The present invention also provides a base assembly for a terminal connecting a fusible switch to a circuit. The base assembly includes a base formed of electrically insulating material and having a generally planar top surface. The base includes a plurality of prongs upstanding from the top surface of the base. Each prong has an undercut between the base top surface and the end of the prong to define a retaining flange. The undercut of each prong is adapted to retain the edges of the terminal. The position of the prongs is adapted to prevent movement of the terminal vertically and in at least one direction horizontally.

The base also includes an interlocking snap having an elongated body cut out from the top surface of the base. The snap body has an integrally formed snap head extending perpendicularly therefrom. The position of the snap is adapted to prevent movement of the terminal in the remaining horizontal directions. The opposite end of the snap body is integrally formed with and resiliently hinged to the base top surface so that the snap flexes at the hinged end to depress the snap body and snap head even with or below the plane of the base top surface.

The present invention further contemplates a line base assembly for terminals connecting a fusible switch to a circuit. The line base assembly includes a base formed of electrically insulating material and having a generally planar top surface. The line base assembly includes a first and second plurality of prongs upstanding from the top surface of the base as described above. The first and second plurality of prongs prevent movement of a respective first and second terminal means vertically and in at least one direction horizontally. A first and second interlocking snap is respectively associated with the first and second plurality of prongs as described above.

The line base assembly also includes first terminal means made of conductive material and having a plurality of edges and opposing edge as described above. The first terminal means has a pair of upstanding legs positioned across from each other and adapted to receive the end of a fuse therebetween. The first terminal means also has reversible switching means for electrically and mechanically connecting the first terminal means to the second terminal means. The switching means is connected to the end of the first terminal means opposite the legs.

The line base assembly further includes second terminal means having a generally planar body made of conductive material with a plurality of edges and an opposed edge as described above. The second terminal means includes a pair of upstanding Jaws positioned across from each other and adapted to receive the end of a knife blade therebetween. The second terminal means further includes means for electrically and mechanically connecting the second terminal body to the other end of the circuit. The connecting means is formed with the second terminal body at the end opposite the leg.

The present invention also provides a fusible switch for one or more phases in a circuit. The switch includes an enclosure defining a switch interior formed by side walls, a back wall, and a front wall. The front wall has a cover removably connected thereto. The switch also includes an operating mechanism for opening and closing a switch contact. The operating mechanism is secured to the enclosure and has a handle accessible from the exterior of the enclosure. The switch further includes a line base assembly and load base assembly as described above.

The present invention further includes a method of assembling a terminal to a base for use in a switch. The method includes the steps of providing a base, providing an electrical terminal, and manually and demountably affixing the terminal to the base.

Preferably, the affixing step includes upstanding a plurality of prongs from the top surface of the base and hinging a snap from the base top surface as described above. The affixing step also includes inserting the edges of the terminal into the undercut of the prongs and depressing the snap even with the plane of the base top surface with the bottom of the terminal. Subsequently, the snap is released to abut the snap head with at least one of the edges of the terminal.

Accordingly, an object of the present invention is to provide a terminal assembly which manually snap-fits together without tools and is also manually demountable.

Another object of the present invention is to provide a terminal assembly which reduces the part count and manual labor needed for a completed assembly compared to the prior art.

A further object of the present invention is to provide a terminal assembly which is less time-consuming and easier to assemble.

Yet another object of the present invention is to provide a terminal assembly which is inexpensive to manufacture.

Other and further advantages, embodiments, variations and the like will be apparent to those skilled in the art from the present specification taken with the accompanying drawings and appended claims.

BRIEF DESCRIPTION OF THE DRAWINGS

In the drawings, which comprise a portion of this disclosure:

FIG. 2 is an isolated perspective view of an inventive line base assembly for a fusible switch;

FIG. 7 is an isolated perspective view of a fourth embodiment of the present invent]on for a fuse clip terminal.

DETAILED DESCRIPTION

Figure 1:
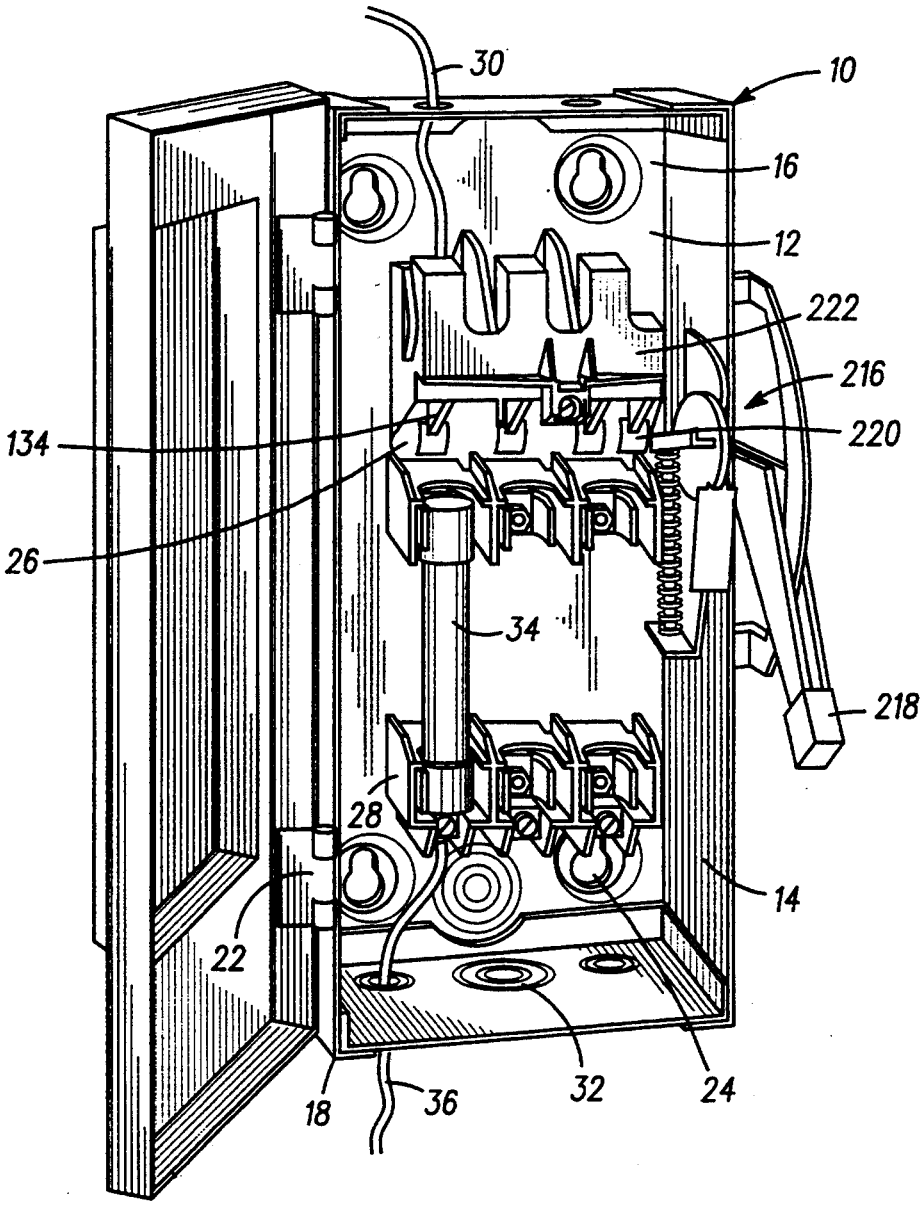
FIG. 1 is a perspective view of a fusible switch containing several terminal assemblies of the present invention.

Referring now to FIG. 1, a fusible switch for a multiphase circuit is indicated by the reference numeral 10. The switch 10 includes an enclosure 12 defined by side walls 14, a back wall 16, and a front wall 18. The switch 10 is enclosed by a cover 20 which connects to the front wall 18 of the enclosure by the hinges 22. Mounting holes 24 are formed in the back wall 16 and are utilized to attach the switch 10 to a wall or the framework of a switchboard (not shown).

In a multiphase circuit, there is an electrical power line 30 for each respective phase. The switch 10 described and illustrated herein is for a three phase circuit. In accordance with the teachings available in the electrical art, it would be within the skill of one to change the number of phases and modify the invention accordingly.

The switch 10 includes a line base assembly 26 and a load base assembly 28 within the interior of the enclosure 12. The power line 30 enters the enclosure 12 through the knock-outs 32 located in the side walls 14 and the back wall 16 to connect to the line base assembly 26. Each phase of the circuit continues across a fuse 34 to connect with the load base assembly 28. For each phase there is an outgoing load line 36 extending through the side wall 14 to make an external connection with the power distribution system.

Figure 3:
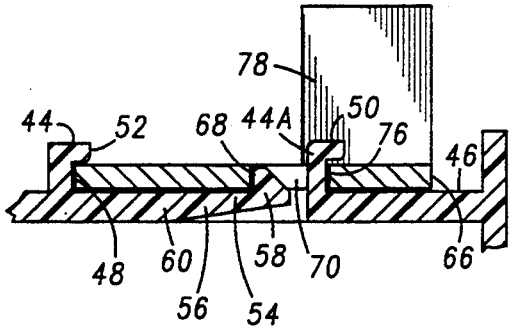
FIG. 3 is a partial cross-sectional view of one embodiment of the present invention for a contact jaws terminal along the lines 3—3 in FIG. 2.

Referring to FIGS. 2 and 3, the line base assembly 26 includes an electrically insulating line base 38 formed of a known insulating material such as the thermoplastic sold by the General Electric Company under the name Valox 420 or 750. The line base 38 is secured to the back wall 16. Any conventional means for fastening the line base 38, such as a sheet metal screw 40 or a bolt, is suitable.

Multiple phases 42 are mounted in spaced apart positions on the line base 38. Each phase includes two pluralities of prongs. The first plurality of prongs includes prongs 44 and 44A integrally formed with the top surface 46 of the base and upstands perpendicularly therefrom. Each prong 44 has an undercut 48 between the top surface 46 and the top end 50 of the prong to define a retaining flange 52.

Associated with the first plurality of prongs is an interlocking snap 54 having an elongated body 56 cut out from the top surface 46 of the base. The snap body 56 is integrally formed with a snap head 58 at one end which upstands perpendicularly therefrom so that the snap head 58 rises above the plane of the base top surface 46. The opposite end 60 of the snap body is integrally formed with and resiliently hinged to the base top surface 46. The snap body 56 flexes at the hinged end 60 to depress the snap head 58 even with or below the plane of the base top surface 46.

The first plurality of prongs is positioned to secure a switch contact jaw terminal 62 inserted between the prongs 44 and 44A. The jaw terminal 62 includes a generally planar jaw body 64 made of conductive material. The jaw body 64 is defined by a plurality of edges 66 which insert into the undercut 48 of the prong 44. The size of the undercut of the prong 44 is pre-determined to allow insertion of the edges 66 therein which prevents movement of the jaw body 64 in one direction horizontally. Simultaneously, the edges 66 abut the retaining flange 52 which also prevents movement of the jaw body 64 in the vertical direction away from the top surface 46 of the base.

Movement of the jaw body 64 in the other three horizontal directions is prevented by the snap 54 and, more specifically, the snap head 58. The jaw terminal 62 further includes one opposing edge 68 which partially defines an aperture 70 in the jaw body 64 and opposes the direction of the plurality of edges 66. The opposing edge 68 is positioned to abut the snap head 58. The width of the snap head abuts the side edges 72 and 74 of the aperture 70 which completes the securing interlock of the jaw terminal 62 in the remaining three horizontal directions.

Preferrably, the aperture 70 in the jaw body is sized to accommodate both the snap head 58 and the prong 44A of the first plurality of prongs 44. The width of prong 44A similarly abuts the side edges 72, 74 of the aperture 70. Together with the end edge 76 of the aperture abutting the undercut of prong 44A, movement of the jaw terminal 62 is prevented in three horizontal directions.

The jaw terminal 62 includes a pair of upstanding legs 78 connected to the jaw body 64. The legs 78 are configured to mechanically and electrically connect with another switch contact represented by a knife blade terminal 80. The present invention contemplates the use of other switch contact means for electrically and mechanically completing each phase of the circuit.

The end 82 of the jaw body opposite the legs 78 is connected to a line lug 84. The line lug 84 is a conventional design with a retaining screw 86 which crimps and secures the power line 30 after it is inserted into an opening 88 in the body of the line lug 84. A tab 90 having a line lug fastener hole 92 therethrough is integrally formed with the line lug 84.

The line lug fastener hole 92 is positioned on the line lug 84 to overlap a jaw body fastener hole 94 centrally located near the end 82 of the jaw body. In turn, both fastener holes 92 and 94 are positioned to overlap a depression 96 in the top surface 46 of the base. Preferably, the depression 96 is in the shape of a hexagonal nut so that a similarly shaped nut 98 is placed within the depression 96. The sides of the nut 98 abut the walls of the depression 96 preventing the nut 98 from rotating.

A conventional threaded fastener like screw 100 inserts through the line lug fastener hole 92 and jaw body fastener hole 94 to engage the nut 98 and mechanically and electrically secure the line lug 84 to the jaw terminal 62. Consequently, the line lug 84 is secured to the line base 38 because the jaw terminal 62 is already secured by the prongs 44/44A the snap 54. Other means for electrically and mechanically connecting the end 82 of the jaw body opposite the legs 78 to the other end of the circuit is suitable for the present invention.

Figure 4:
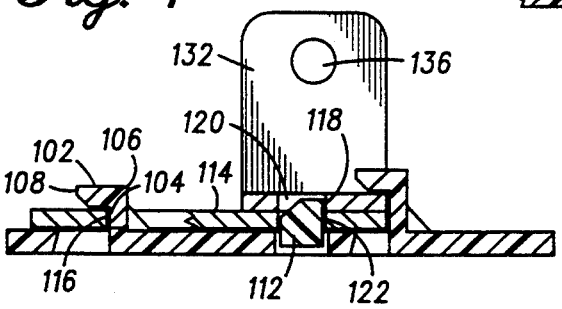
FIG. 4 is a partial cross-sectional view of another embodiment of the present invention for a knife blade terminal along the lines 4—4 in FIG. 2.

Referring now to FIGS. 2 and 4, each phase 42 includes a second plurality of prongs 102. The second plurality of prongs 102 is integrally formed with the top surface 46 of the base and upstands perpendicularly therefrom. Each prong 102 has an undercut 104 between the top surface 46 and the top end 106 of the prong to define a retaining flange 108.

Associated with the second plurality of prongs 102 is a second interlocking snap 110 having a similar shape and flexing function as the first snap 54. The second snap 110 is integrally formed with a snap head 112 at one end which upstands perpendicularly therefrom so that the snap head 112 rises above the plane of the base top surface 46.

The second plurality of prongs 102 is positioned to secure the knife blade terminal 80 inserted between the prongs 102. The blade terminal 80 includes a generally planar blade body 114 made of conductive material. The blade body 114 is defined by a plurality of edges 116 which insert into the undercut 104 of the prongs 102. As previously discussed with regard to the first plurality of prongs 44, the size of the undercut of the prongs 102 is pre-determined to allow insertion of the edges 116 therein. Likewise, the edges 116 abut the retaining flanges 108 which prevent movement of the blade body 114 in the vertical direction away from the top surface 46 of the base. The second prongs 102, however, only prevent movement of the blade body 114 in one direction horizontally.

Movement of the blade body 114 in the other three horizontal directions is prevented by the second snap 110 as specifically illustrated in FIG. 4. The blade terminal 80 further includes one opposing edge 118 which partially defines an aperture 120 in the blade body 114 and opposes the direction of the plurality of edges 116. The opposing edge 118 is positioned to abut a back face 122 of the second snap head 112. The aperture 120 in the blade body is further defined by side edges 124 which are sized to abut the sides 126 of the second snap head. The abutting relationship between the back face 122 with the opposing edge 118 and additionally between the sides 126 of the snap head with the side edges 124 of the aperture completes the securing interlock of the blade terminal 80 in the remaining three horizontal directions.

In conjunction with the interlocking feature of the second snap head 112, movement of the blade terminal 80 is also prevented in two sidewise directions horizontally by the side edges 128 of the blade body 114. To separate the individual phases, the line base 38 is integrally formed with upstanding walls 130 spaced apart and parallel to one another. The distance between the side edges 128 of the blade body is sized to form an abutting relationship between the upstanding walls 130 and side edges 128. This prevents movement of the blade body 114 in the two sidewise directions horizontally.

The blade terminal 80 includes an upstanding support leg 132 connected to the blade body 114. The support leg 132 is rotatably connected to a knife blade switch contact 134 at pivot pin 136. The knife blade 134 is configured to mechanically and electrically connect with another switch contact represented by the jaw terminal 62. As discussed before, the present invention contemplates the use of other switch contact means for electrically and mechanically completing each phase of the circuit.

The end 138 of the blade body opposite the support leg 132 is connected to a line fuse clip 140. The line fuse clip 140 is defined by a pair of upstanding legs 142 integrally formed with and extending perpendicularly from a planar support base 144. The legs 142 are configured to retain the fuse 34 therebetween. The base 144 includes a fuse clip fastener hole 146 therethrough.

The fuse clip fastener hole 146 is positioned on the base 144 to overlap a blade body fastener hole 148 centrally located near the opposite end 138 of the blade body. In turn, both fastener holes 146 and 148 are positioned to overlap a depression 150 in the top surface 46 of the base. Preferably, the depression 150 is in the shape of a hexagonal nut so that a similarly shaped nut 152 is placed within the depression 150. The sides of the nut 152 abut the walls of the depression 150 preventing the nut 152 from rotating.

A conventional threaded fastener like screw 154 inserts through the fuse clip fastener hole 146 and blade body fastener hole 148 to engage the nut 152 and mechanically and electrically secure the line fuse clip 40 to the blade terminal 80. Consequently, the line fuse clip 140 is secured to the line base 38 because the blade terminal 80 is already secured by the second prongs 102 and the second snap 110. Other means for electrically and mechanically connecting the end 138 of the blade body opposite the support leg 132 to the other end of the circuit is suitable for the present invention.

Figure 6:
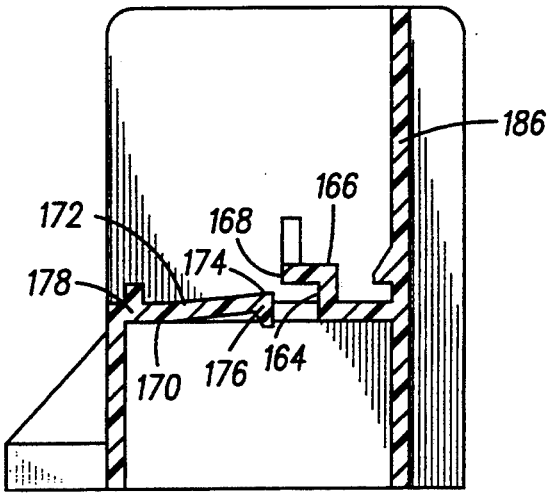
FIG. 6 is an isolated cross-sectional view of a third embodiment of the present invention for a fuse clip base along the lines 6—6 in FIG. 5.
Figure 5:
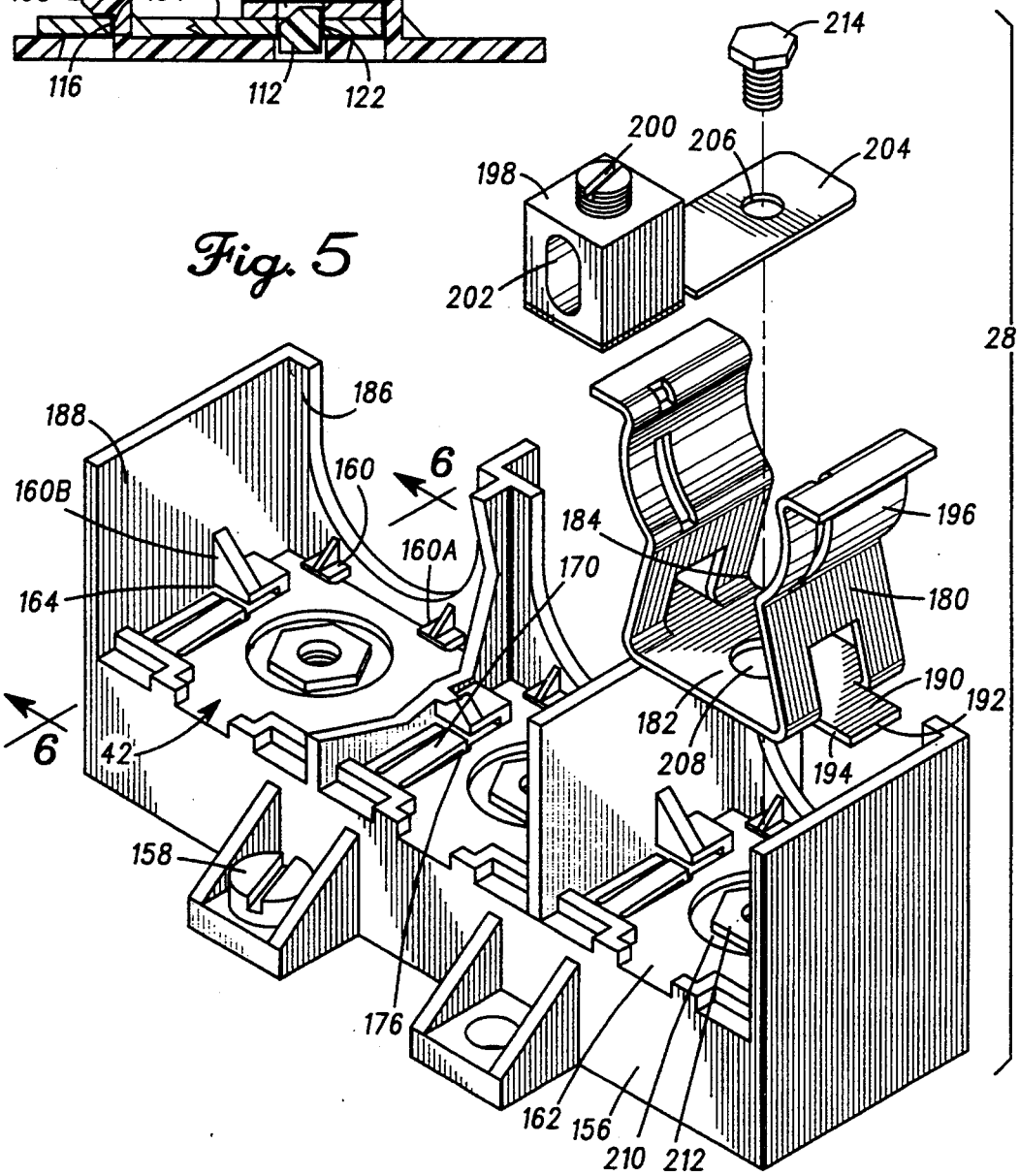
FIG. 5 is an isolated perspective view of a load base assembly for a fusible switch.

Referring now to FIGS. 5 and 6, the load base assembly 28 includes an electrically insulating load base 156 formed of a known insulating material such as the thermoplastic sold by the General Electric Company under the name Valox 420 or 750. The load base 156 is secured to the back wall 6. Any conventional means for fastening the load base 156, such as a sheet metal screw 158 or a bolt, is suitable.

As previously described, multiple phases 42 are similarly mounted in spaced apart positions on the load base 156. Each phase 42 includes a third plurality of prongs 160 integrally formed with the top surface 162 of the load base and upstands perpendicularly therefrom. Each of the third plurality of prongs 160 has an undercut 164 between the top surface 162 and the top end 166 of each prong to define a retaining flange 168.

Associated with the third plurality of prongs 160 is a third interlocking snap 170 having an elongated body 172 cut out from the top surface 162 of the load base. One end 174 of the third snap body 172 rises above the plane of the load base top surface 162. The end 174 of the third snap body is integrally formed with a third snap head 176 which extends perpendicularly downward therefrom so that the third snap head 176 extends below the plane of the load base top surface 162. The opposite end 178 of the third snap body is integrally formed with and resiliently hinged to the load base top surface 162. The third snap body 172 flexes at the hinged end 178 to depress the third snap body 172 even with and the third snap head 176 below the plane of the load base top surface 162.

The third plurality of prongs 160 is positioned to secure a load fuse clip terminal 180 inserted between the third prongs 160. The clip terminal 180 includes a generally planar clip body 182 made of conductive material. The clip body 182 is defined by a plurality of edges 184 which insert into the undercut 164 of the third prongs 160. As previously discussed with regard to the first plurality of prongs 44, the size of the undercut of the prongs 164 is pre-determined to allow insertion of the edges 184 therein. Likewise, the edges 184 abut the retaining flanges 168 which prevent movement of the clip body 182 in the vertical direction away from the top surface 162 of the load base.

Prongs 160A of the third plurality of prongs 160 are integrally formed with a wall 186 upstanding from the load base top surface 162 to prevent movement of the clip body 182 in one direction horizontally. Prongs 160B of the third plurality of prongs 160 are partially formed with an upstanding wall 188 to form an L-shaped corner which edges 190 and 192 of the clip body abut to prevent movement in three directions horizontally.

Movement of the clip body 182 in the remaining horizontal direction is prevented by the third snap 170. The clip body 182 further includes one opposing edge 194 which opposes the direction of the plurality of edges 184, 190, and 192. The opposing edge 194 is positioned to abut the third snap head 176 which completes the securing interlock of the clip terminal 180 in all four horizontal directions.

The clip terminal 180 includes a pair of upstanding legs 196 connected to the clip body 182. The legs 196 are configured to mechanically and electrically connect with one end of the fuse 34. The present invention contemplates the use of other switch contact means for electrically and mechanically completing the connection to the fuse 34. For example, but not limited to, a bolted stab arrangement is suitable to connect the load fuse clip terminal 180 or the line fuse clip 140 to the fuse 34.

The clip body 182 is connected to a load lug 198. The load lug 198 is a conventional design with a retaining screw 200 which crimps and secures the load line 36 after it is inserted into an opening 202 in the body of the load lug 198. A tab 204 having a fastener hole 206 therethrough is integrally formed with the load lug 198.

The load lug fastener hole 206 is positioned on the load lug 198 to overlap a clip body fastener hole 208 centrally located on the clip body 182. In turn, both fastener holes 206 and 208 are positioned to overlap a depression 210 in the load base top surface 162. Preferably, the depression 210 is in the shape of a hexagonal nut so that a similarly shaped nut 212 is placed within the depression 210. The sides of the nut 212 abut the walls of the depression 210 preventing the nut 212 from rotating.

A conventional threaded fastener like screw 214 inserts through the load lug fastener hole 206 and clip body fastener hole 208 to engage the nut 212 and mechanically and electrically secure the load lug 198 to the clip terminal 180. Consequently, the load lug 198 is secured to the load base 156 because the clip terminal 180 is already secured by the prongs 160 and the snap 170. Other means for electrically and mechanically connecting the legs 196 with the fuse 34 to the other end of the circuit is suitable for the present invention.

The terminals described above make a snap-fit connection with their corresponding bases by sliding the edges of the terminals into engagement with the prongs. An alternate embodiment of the present invention is depicted in FIG. 7 which uses a rotating motion to connect a fuse clip terminal 280 to a base 256.

As similarly described above, a fourth plurality of prongs 260 is integrally formed with the top surface 262 of the base 256 and upstands perpendicularly therefrom. Each of the fourth plurality of prongs 260 has an undercut 264 between the top surface 262 and the top end 266 of each prong to define a retaining flange 268.

Associated with the fourth plurality of prongs 260 is a fourth interlocking snap 270 having an elongated body 272 cut out from the top surface 262 of the base. One end 274 of the fourth snap body 272 rises above the plane of the base top surface 262. The end 274 of the fourth snap body is integrally formed with a fourth snap head 276 which extends perpendicularly downward therefrom so that the fourth snap head 276 extends below the plane of the base top surface 262. The opposite end 278 of the fourth snap body is integrally formed with and resiliently hinged to the base top surface 262. The fourth snap body 272 flexes at the hinged end 278 to depress the fourth snap body 272 even with and the fourth snap head 276 below the plane of the base top surface 262.

The fourth plurality of prongs 260 is positioned to secure a fuse clip terminal 280 inserted therebetween. The clip terminal 280 includes a generally planar clip body 282 defined by a plurality of edges 284 which insert into the undercut 264 of the fourth prongs 260. As previously discussed with regard to the first plurality of prongs 44, the size of the undercut of the prongs 264 is pre-determined to allow insertion of the edges 284 therein. Likewise, the edges 284 abut the retaining flanges 268 which prevent movement of the clip body 282 in the vertical direction away from the top surface 262 of the base.

Prongs 260A of the fourth plurality of prongs 260 have an elongated curved shape. The curvature approximates the width of the fuse clip body 282. Preferably, the prongs 260A are closed at one end to form an L-shaped corner which the edges 284 of the clip body abut to prevent movement in three directions horizontally. Prong 260B of the fourth plurality of prongs 260 prevents further rotation during the counter-clockwise insertion of the fuse clip 280. Movement of the clip body 282 in the clockwise direction is prevented by the fourth snap 270. The clip body 282 further includes one opposing edge 294 which opposes the direction of the plurality of edges 284. The opposing edge 294 is positioned to abut the fourth snap head 276 which completes the securing interlock of the clip terminal 280 in all four horizontal directions.

The clip terminal 280 includes a pair of upstanding legs 296 connected to the clip body 282. The legs 296 are configured to mechanically and electrically connect with one end of the fuse 34.

Referring back to FIG. 1, an operating mechanism 216 opens and closes the switch contacts of the knife blade 134 and jaw terminal 62 for each phase of the circuit. A handle 218 is connected to the operating mechanism 216 to work the switch contacts manually from the exterior of the enclosure 12. A rotor 220 is used to open and close the knife blade 134 of each phase in unison along a common axis.

The switch contacts are overlapped by an arc suppressor assembly 222 attached to the line base assembly 26. The arc suppressor assembly is a one piece housing made of thermoplastic material similar to that described for the base assemblies. The arc suppressor assembly 222 effectively surrounds the switch contacts to protect the other components in the enclosure 12 from damage by the arc released when the knife blade 134 engages or disengages the jaw terminal 62.

The present invention contemplates a method of assembling a terminal to a base for use in a switch. The method includes the steps of providing a base and an electrical terminal. A further step of the inventive method includes manually and demountably affixing the terminal to the base.

Preferably, the affixing step includes upstanding a plurality of prongs from the top surface of the base. Each prong has an undercut between the base top surface and the end of the prong to define a retaining flange. A snap is cut from the base top surface. The snap has a snap head at one end and the opposite end integrally forms with and is resiliently hinged to the base top surface.

The affixing step also includes inserting the edges of the terminal into the undercut of the prongs and depressing the snap even with the plane of the base top surface with the bottom of the terminal. Subsequently, the snap is released to abut the snap head with at least one of the edges of the terminal.

The inserting step includes sliding the edges of the terminal into the undercuts of the prongs or rotating the edges of the terminal underneath the retaining flanges of the prongs. Preferably, the snap head has a slanted face which engages the terminal edges first so as to ease the sliding or rotating motion. The structure of the prongs, snap, terminal, and base is more specifically described above.

One of the advantages demonstrated by the present invention is the flexibility in mounting terminals of various shapes and sizes to different bases. The present invention contemplates adapting the shape of the prongs to suit the contour of the base surface and the type of terminal, i.e., self-supporting prongs 44, prongs 160A integrally formed with upstanding walls, and prongs like 160B which form corner shapes.

Additionally, the present invention discloses adapting the shape of the interlocking snap to either have the body of the snap 172 or the snap head 58 extend above the plane of the base top surface to abut the terminal.

While particular embodiments and applications of the present invention have been illustrated and described, it is to be understood that the invention is not limited to the precise construction and compositions disclosed herein and that various modifications, changes, and variations which will be apparent to those skilled in the art may be made in the arrangement, operation, and details of construction of the invention disclosed herein without departing from the spirit and scope of the invention as defined in the appended claims.

What is claimed is:

1. A terminal for connecting a fusible switch base to a circuit, the base having a plurality of undercut prongs upstanding therefrom and an interlock snap resiliently hinged thereto, the prongs being positioned on the base to prevent movement of the terminal vertically and in at least one of a plurality of horizontal directions, the snap being positioned on the base to prevent movement of the terminal in all other horizontal directions, the terminal comprising:

a generally planar body made of conductive material, the body having a plurality of edges being adapted to insert into the undercut prongs;

an opposing edge positioned on the body opposite the plurality of edges, the opposing edge being adapted to abut one end of the interlock snap;

an upstanding leg connected to the body, the leg being formed with first means for electrically and mechanically connecting the leg to the circuit; and second means for electrically and mechanically connecting the body to the other end of the circuit, the body being formed with the second connecting means at the end opposite the leg.

2. The terminal defined in claim 1 wherein the opposed edge is an internal edge partially defining an aperture in the body, the aperture is adapted to receive the end of the snap and abut the internal opposed edge.

3. The terminal defined in claim 2 wherein the aperture is further adapted to receive one of the plurality of prongs and the other edges defining the aperture are adapted to abut the one prong.

4. The terminal defined in claim 1 wherein the opposed edge is an external edge partially defining the circumference of the body, the external opposed edge is adapted to abut the snap.

5. The terminal defined in claim 1 wherein the body further includes a second upstanding leg, the second leg is positioned parallel and spaced apart from the first leg and is adapted to hold the fuse therebetween.

6. The terminal defined in claim 1 wherein the first connecting means includes a second upstanding leg, the second leg is positioned parallel and closely spaced to the first leg and is adapted to form a switch contact jaw pair.

7. The terminal defined in claim 1 wherein the first connecting means includes a switch contact knife blade and a hole extending through the leg, the hole is adapted to receive a fastener rotatably connecting the knife blade to the support leg.

8. The terminal defined in claim 1 wherein the second connecting means includes a hole extending through the body, the hole is adapted to receive a fastener connected to a line lug.

9. A base assembly for a terminal connecting a fusible switch to a circuit, the base assembly comprising:

a base formed of electrically insulating material, the base having a generally planar top surface;

a plurality of prongs upstanding from the top surface of the base, each prong having an undercut between the base top surface and a top end to define a retaining flange, the undercut of the prongs being adapted to retain edges on the terminal, the position of the prongs being adapted to prevent movement of the terminal vertically and in at least one of a plurality of horizontal directions, wherein at least two of the prongs are further defined by a curved elongated shape adapted to correspond to the diameter of the terminal, the undercut of the curved prongs forming a channel adapted to receive the edges of the terminal and rotate therethrough, the curved prongs having a stop flange extending perpendicular to the undercut so that the terminal edge abuts the stop flange to prevent further rotation; and an interlocking snap having a first end, a second end and an elongated body cut out from the top surface of the base, the snap body having an integrally formed snap head at one end extending perpendicularly therefrom, the position of the snap being adapted to prevent movement of the terminal in all other horizontal directions, the snap body having a second end being integrally formed with and resiliently hinged to the base top surface so that the snap flexes at the second end to allow movement of the snap head from above the top surface of the base to below the top surface.

10. The base assembly defined in claim 9 wherein the base further includes a depression centrally located between the prongs, the depression being adapted for fixedly receiving one end of a fastener.

11. The base assembly defined in claim 9 wherein at least one of the prongs is defined by an L-shape and having a bottom end larger than the top end to reinforce the connection of the prong with the base top surface so that the prong is self-supporting.

12. The base assembly defined in claim 9 wherein at least one of the prongs is integrally formed with an upstanding wall extending perpendicularly from the base top surface, the undercut is defined by the face of the wall and the retaining flange extends parallel to and perpendicularly upward from the wall face.

13. The base assembly defined in claim 9 wherein at least one of the prongs is connected at one end with an upstanding wall extending perpendicularly from the base top surface, the undercut and the retaining flange of the prong both extend perpendicularly from the wall face so that a corner shape is formed.

14. The base assembly defined in claim 9 wherein the hinged end of the snap is angled so that the snap body rises above the plane of the base top surface and the snap head extends downwardly to the plane of the base top surface.

15. The base assembly defined in claim 9 wherein the hinged end of the snap is level so that the snap body is parallel to the plane of the base top surface and the snap head extends upwardly above the plane of the base top surface.

16. The base assembly defined in claim 9 wherein the base assembly further includes a terminal having:

a generally planar body made of conductive material, the body having a plurality of edges for inserting into the undercut of the prongs;

an opposing edge positioned on the body opposite the plurality of edges, the opposing edge abutting one end of the interlock snap;

an upstanding leg connected to the body, the leg being formed with first means for electrically and mechanically connecting the leg to the circuit; and second means for electrically and mechanically connecting the body to the other end of the circuit, the body being formed with the second connecting means at the end opposite the leg.

17. A line base assembly for terminals connecting a fusible switch to a circuit, the line base assembly comprising:

a base formed of electrically insulating material, the base having a generally planar top surface;

a first and second plurality of prongs upstanding from the top surface of the base, each prong having an undercut between the base top surface and the end of the prong to define a retaining flange, the undercut of the prongs being adapted to retain the edges of first and second terminal means, the position of the prongs being adapted to prevent movement of the first and second terminal means vertically and in at least one of a plurality of horizontal directions; and a first and second interlocking snap respectively associated with the first and second plurality of prongs and having an elongated body cut out from the top surface of the base, each snap body having integrally formed snap head extending perpendicularly therefrom, the position of each snap being adapted to prevent movement of the respective first and second terminal means in all other horizontal directions, the opposite end of each snap body being integrally formed with and resiliently hinged to the base top surface so that each snap flexes at the hinged end to allow movement of the snap head from above the top surface of the base to below the top surface;

first terminal means made of conductive material and including:

a plurality of edges being sized to insert into the undercut of the first plurality of prongs, the first plurality of prongs being positioned to prevent movement of the terminal means vertically and in at least one direction horizontally.

an opposing edge being positioned on the first terminal means opposite the plurality of edges, the opposing edge abutting the first snap head, a pair of upstanding legs connected to the first terminal means, the legs being positioned across from each other and being adapted to receive the end of a fuse therebetween, and reversible switching means for electrically and mechanically connecting the first terminal means to the second terminal means, the switching means connected the end of the first terminal means opposite the legs; and second terminal means including:

a second terminal body being generally planar and made of conductive material, the second terminal body having a plurality of edges being sized to insert into the undercut of the second plurality of prongs, the second plurality of prongs being positioned to prevent movement of the second terminal body vertically and in at least one direction horizontally, an opposing edge being positioned on the second terminal body opposite the plurality of edges, the opposing edge of the second terminal body abutting the second snap head, a pair of upstanding jaws connecting to the second terminal body, the jaws being positioned across from each other and being adapted to receive the end of a knife blade therebetween, and means for electrically and mechanically connecting the second terminal body to the other end of the circuit, the second terminal body being formed with the connecting means at the end opposite the leg.

18. The line base assembly defined in claim 17 wherein the first terminal means includes:

a switch terminal having:

a generally planar switch body having the edges being sized to insert into the undercut of the first plurality of prongs, the opposing edge of the first terminal means being positioned on the switch body opposite the edges and abutting the first snap head, and the reversible switching means being connected to one end of the switch body opposite the legs; and a line fuse terminal having:

a generally planar line fuse body having edges sized to insert between the first plurality of prongs and partially overlap the switch body, a hole in the line fuse body being centrally located and adapted for receiving a fastener therethrough, and the legs connecting to the line fuse body, the legs being positioned across from each other and being adapted to receive the end of a fuse therebetween.

19. The line base assembly defined in claim 18 wherein the reversible switching means includes a knife blade and a support leg, the support leg connecting to the switch body and having a distal end upstanding perpendicularly therefrom, the knife blade having one end rotatably connected to the distal end of the support leg, the position of the support leg corresponding to the jaws of the second terminal body so that the opposite end of the knife blade electrically and mechanically connects with the jaws.

20. The line base assembly defined in claim 18 wherein the connecting means includes a line lug, a fastener, and a hole in the second terminal body, the fastener extending through the hole and the line lug, the fastener is fixedly received in the depression.

21. The line base assembly defined in claim 17 wherein the base further includes a depression centrally located between the prongs, the depression being adapted for fixedly receiving one end of a fastener.

22. A fusible switch for one or more phases in a circuit, the switch comprising;

an enclosure defining a switch interior formed by side walls, a back wall, and a front wall, the front wall having a cover removably connected thereto;

an operating mechanism for opening and closing a switch contact, the operating mechanism being secured to the enclosure and having a handle accessible from the exterior of the enclosure;

a line base assembly having a base formed of electrically insulating material, the base having a generally planar top surface to accommodate each phase thereon, each phase having:

a first and second plurality of prongs upstanding from the top surface of the base, each prong having an undercut between the base top surface and the end of the prong to define a retaining flange, the undercut of the prongs being adapted to retain the edges of first and second terminal means, the position of the prongs being adapted to prevent movement of the first and second terminal means vertical and in at least one of a plurality of horizontal directions, a first and second interlocking snap respectively associated with the first and second plurality of prongs and having an elongated body cut out from the top surface of the base, each snap body having integrally formed snap head extending perpendicularly therefrom, the position of each snap being adapted to prevent movement of the respective first and second terminal means in all other horizontal directions, the opposite end of each snap body being integrally formed with and resiliently hinged to the base top surface so that each snap flexes at the hinged end to allow movement of the snap head from above the top surface of the base to below the top surface, first terminal means made of conductive material and including:

a plurality of edges being sized to insert into the undercut of the first plurality of prongs, the first plurality of prongs being positioned to prevent movement of the first terminal means vertically and in at least one direction horizontally, an opposing edge being positioned on the first terminal means opposite the plurality of edges, the opposing edge abutting the first snap head, a pair of upstanding legs connected to the first terminal means, the legs being positioned across from each other and being adapted to receive the end of a fuse therebetween, and reversible switching means for electrically and mechanically connecting the first terminal means to the second terminal means, the switching means being connected to the end of the first terminal means opposite the legs; and second terminal means including:

a second terminal body being generally planar and made of conductive material, the second terminal body having a plurality of edges being sized to insert into the undercut of the second plurality of prongs, the second plurality of prongs being positioned to prevent movement of the second terminal body vertically and in at least one direction horizontally, an opposing edge being positioned on the second terminal body opposite the plurality of edges, the opposing edge of the second terminal body abutting the second snap head, a pair of upstanding jaws connecting to the second terminal body, the jaws being positioned across from each other and being adapted to receive the end of a knife blade therebetween, and means for electrically and mechanically connecting the second terminal body to the other end of the circuit, the second terminal body being formed with the connecting means at the end opposite the leg; and a load assembly having a base formed of electrically insulating material, the base having a generally planar top surface to accommodate each phase thereon, each phase having:

a plurality of prongs upstanding from the top surface of the base, each prong having an undercut between the base top surface and the end of the prong to define a retaining flange, the undercut of the prongs being adapted to retain the edges of the terminal, the position of the prongs being adapted to prevent movement of the terminal vertically and in at least one of a plurality of horizontal directions, an interlocking snap having an elongated body cut out from the top surface of the base, the snap body having integrally formed snap head extending perpendicularly therefrom, the position of the snap being adapted to prevent movement of the terminal in all other horizontal directions, the opposite end of the snap body being integrally formed with and resiliently hinged to the base top surface so that the snap flexes at the hinged end to allow movement of the snap head from above the top surface of the base to below the top surface, and a load fuse terminal having:

a generally planar load fuse body made of conductive material, the load fuse body having a plurality of edges for inserting into the undercut of the prongs, an opposing edge positioned on the load fuse body opposite the plurality of edges, the opposing edge abutting one end of the interlock snap, an upstanding leg connected to the load fuse body, the leg being formed with first means for electrically and mechanically connecting the leg to the circuit, and second means for electrically and mechanically connecting the body to the other end of the circuit, the load fuse body being formed with the second connecting means at the end opposite the leg.

23. The switch defined in claim 22 wherein the first terminal means includes:

a switch terminal having:

a generally planar switch body having the edges being sized to insert into the undercut of the first plurality of prongs, the opposing edge of the first terminal means being positioned on the switch body opposite the edges and abutting the first snap head, and the reversible switching means being connected to one end of the switch body; and a line fuse terminal having:

a generally planar line fuse body having edges sized to insert between the first plurality of prongs and partially overlap the switch body, a hole in the line fuse body being centrally located and adapted for receiving a fastener therethrough, and the legs connecting to the line fuse body, the legs being positioned across from each other and being adapted to receive the end of a fuse therebetween.

24. The switch defined in claim 23 wherein the reversible switching means includes a knife blade and a support leg, the support leg connecting to the switch body and having a distal end upstanding perpendicularly therefrom, the knife blade having one end rotatably connected to the distal end of the support leg, the position of the support leg corresponding to the jaws of the second terminal body so that the opposite end of the knife blade electrically and mechanically connects with the jaws.

25. The switch defined in claim 22 wherein the body further includes a second upstanding leg, the second leg being positioned parallel to the first leg and adapted to hold the fuse therebetween.

26. The switch defined in claim 22 wherein the second connecting means further includes a hole extending through the body, the hole is adapted to receive a fastener connected to a load lug, the connecting means further includes a line lug, a fastener, and a hole in the second terminal body, the fastener extending through the hole and the line lug, the fastener is fixedly received in the depression.

27. A base assembly for a terminal connecting a fusible switch to a circuit, the base assembly comprising:

a base formed of electrically insulating material, the base having a generally planar top surface;

a plurality of prongs upstanding from the top surface of the base, each prong having an undercut between the base top surface and a top end to define a retaining flange, the undercut of the prongs being adapted to retain edges on the terminal, the position of the prongs being adapted to prevent movement of the terminal vertically and in at least one of a plurality of horizontal directions;

an interlocking snap having a first end, a second end and an elongated body cut out from the top surface of the base, the snap body having an integrally formed snap head at one end extending perpendicularly therefrom, the position of the snap being adapted to prevent movement of the terminal in all other horizontal directions, the snap body having a second end being integrally formed with and resiliently hinged to the base top surface so that the snap flexes at the second end to allow movement of the snap head from above the top surface of the base to below the top surface; and a terminal including:

a generally planar body made of conductive material, the body having a plurality of edges for inserting into the undercut of the prongs;

an opposing edge positioned on the body opposite the plurality of edges, the opposing edge abutting one end of the interlock snap;

an upstanding leg connected to the body, the leg being formed with first means for electrically and mechanically connecting the leg to the circuit; and second means for electrically and mechanically connecting the body to the other end of the circuit, the body being formed with the second connecting means at the end opposite the leg.

* * * * *